United States Patent [19]

Mitsuhashi et al.

[11] Patent Number: 4,975,047

[45] Date of Patent: Dec. 4, 1990

[54] OVEN PROVIDED WITH OXYGEN CONCENTRATION CONTROLS

[75] Inventors: Kenhachi Mitsuhashi, Kanagawa; Shigeru Suga, Tokyo, both of Japan

[73] Assignees: Suga Test Instruments Co., Ltd.; The Yokohama Rubber Co., Ltd., both of Tokyo, Japan

[21] Appl. No.: 383,149

[22] Filed: Jul. 19, 1989

[30] Foreign Application Priority Data

Aug. 24, 1988 [JP] Japan ..... 63-208045

[51] Int. Cl.[5] ..... F27B 9/04

[52] U.S. Cl. ..... 432/23; 432/37; 432/72

[58] Field of Search ..... 432/23, 37, 48, 57, 432/72

[56] References Cited

U.S. PATENT DOCUMENTS

| | | | |
|---|---|---|---|
| 3,366,374 | 1/1968 | Bay et al. | 432/23 |
| 3,514,085 | 5/1970 | Woock | 432/23 |
| 3,824,066 | 7/1974 | Muranyi et al. | 432/37 |
| 4,147,500 | 4/1979 | Karlsoen | 432/72 |
| 4,490,108 | 12/1984 | Petzi | 432/37 |

*Primary Examiner*—Henry C. Yuen

*Attorney, Agent, or Firm*—Wenderoth, Lind & Ponack

[57] ABSTRACT

A test oven wherein heated air having a predetermined temperature is supplied and the oxygen concentration in the supplied air is controlled. The test oven has a test oven body having an air supply port and an air discharge port, a blower connected to the air supply port for blowing air thereinto, an oxygen concentration detector connected to the test oven body, an oxygen concentration setting control unit connected to the oxygen concentration detecting detector and including an oxygen concentration setter for setting a desired level of oxygen, and an oxygen concentration controller constantly comparing a reference output level generated on the basis of a concentration level set in advance in the oxygen concentration setter with an output level outputted from the oxygen concentration detector and for controling the actual output level to a set level, and at least one oxygen concentration adjusting device. This can be an oxygen and nitrogen supply unit controlled by the oxygen concentration setting control unit for supplying an amount of oxygen and/or nitrogen to an air circulating passage upstream of the blower for regulating the concentration of the oxygen in response to the actual output level of the oxygen concentration setting control, or it can be a blower speed control for controlling the speed of the blower in accordance with such actual output level to blow air from outside into the oven body.

3 Claims, 5 Drawing Sheets

OVEN PROVIDED WITH OXYGEN CONCENTRATION CONTROLS

BACKGROUND OF THE INVENTION

1. Field of the Invention:

This invention relates to an oven provided with oxygen concentration controls, and more particularly to an oven provided with oxygen concentration controls and used to subject, for example, a rubber or plastic material or a product thereof to a heat aging test.

2. Description of the Prior Art

In general, during a heat aging test for a rubber or plastic material or a product thereof, a predetermined quantity per hour of the air in the test oven is replaced by the outside air, whereby the test is conducted as the ventilation of the test oven is properly controlled.

The regulating of the ventilation of the test oven is done by introducing and discharging a predetermined quantity, which corresponds to a predetermined frequency of ventilation, of air into and from the test oven on the basis of a change at least once per hour of such a quantity of air in the test oven that corresponds to the capacity thereof (according to JIS K 6301).

In a conventional heat aging test, the flow rate of the air introduced into the test oven and that of the air discharged therefrom are regulated but the testing of a sample is carried out actually irrespective of a decrease and variation of oxygen concentration occurring due to the absorption of oxygen by the sample being tested.

In such an oven, the aging of a rubber or plastic material is promoted by the oxygen in addition to the effect of the heat. Namely, when a decrease and variation of the oxygen concentration occurs in the test oven due to the number and oxygen absorption rate of the sample, the results of the test are influenced thereby greatly.

Therefore, if the oxygen concentration is not controlled during a test, the accuracy of the test decreases, and test results having reproducibility cannot be obtained. According to the conventional techniques of this kind, it is impossible to control the oxygen concentration in such a test oven.

SUMMARY OF THE INVENTION

An object of the present invention, which has been developed in view of these problems encountered in a conventional oven of this kind, is to provide an oven provided with oxygen concentraction controls, capable of improving the accuracy of a heat aging test and obtaining heat aging test results of an excellent reproducibility by conducting a heat aging test as the test oven is ventilated suitably with the oxygen concentration in the test oven controlled constantly to a predetermined level.

To achieve this object the present invention provides an oven provided with oxygen concentration controls, consisting of a test oven body having an air supply port and an air discharge port, an outer air circulating passage connecting the air supply port and air discharge port together, a blower provided in the outer air circulating passage so as to ventilate the test oven body, an oxygen concentration detector adapted to detect the oxygen concentration in and connected to the test oven body and having an oxygen concentration detecting circuit therein, an oxygen concentration setting control unit connected to the oxygen concentration detecting circuit and consisting of an oxygen concentration setter, and an oxygen concentration controller adapted to constantly compare a reference output level generated on the basis of a concentration level set in the oxygen concentration setter with an output level sent out from the oxygen concentration detector and control the actual output level to a set level, and an oxygen and nitrogen supply unit adapted to supply oxygen or nitrogen to the interior of the portion of the outer air circulating passage which is on the upstream side of the blower in accordance with an output signal from the oxygen concentration setting control unit so as to regulate the oxygen concentration.

The present invention further provides an oven provides an oven provided with oxygen concentration controls, wherein heated air having a predetermined temperature is supplied to a test oven body having an air supply port and an air discharge port, to control the oxygen concentration in the test oven body, consisting of an outer air circulating passage connecting the air supply port and air discharge port together, a blower provided in the outer air circulating passage, and an oxygen concentration detector connected to the test oven body and adapted to detect the oxygen concentration in the test oven body, the number of revolutions per minute of the blower being regulated in accordance with an oxygen concentration signal from the oxygen concentration detector so as to control the frequency of ventilation of the test oven body.

The present invention further provides an oven provided with oxygen concentration controls, wherein heated air having a predetermined temperature is supplied to a test oven body having an air supply port and an air discharge port, to control the oxygen concentration in the test oven body, consisting of an outer air circulating passage connecting the air supply port and air discharge port together, a blower provided in the outer air circulating passage, an oxygen concentration detector adapted to detect the oxygen concentration in and connected to the test oven body and having an oxygen concentration detecting circuit therein, an oxygen concentration setting control unit connected to the oxygen concentration detecting circuit and consisting of an oxygen concentration setter, and an oxygen concentration controller adapted to constantly compare a reference output level generated on the basis of a concentration level set in the oxygen concentration setter with an output level sent out from the oxygen concentration detector and control the actual output level to a set level, an oxygen and nitrogen supply unit adapted to supply oxygen or nitrogen to the interior of the portion of the outer air circulating passage which is on the upstream side of the blower in accordance with an output signal from the oxygen concentration setting control unit so as to regulate the oxygen concentration, an atmospheric air supply passage connected to the portion of the outer air circulating which is on the upstream side of the blower, and a circuit change-over control valve provided in the outer air circulating passage and adapted to switch one of an operation for supplying oxygen or nitrogen from the oxygen and nitrogen supply unit and an operation for introducing the atmospheric air from the atmospheric supply passage to the other, the number of revolutions per minute of the blower being controlled in accordance with an output signal from the oxygen concentration setting control unit.

The present invention is constructed as described above and characterized in that the air in the test oven body is circulated in the outer air circulating passage as it is regulated to a predetermined flow rate by the blower provided in the same circulating passage, the oxygen concentration in the test oven body being detected by the oxygen concentration detector extended to the interior of the test oven body, to output a signal which corresponds to the level detected of the oxygen concentration to the oxygen concentration setting control unit, oxygen or nitrogen being supplied to the interior of the portion of the outer air circulating passage which is on the upstream side of the belower in accordance with an output signal from the oxygen concentration setting control unit so as to regulate the oxygen concentration to a predetermined level.

The ventilation rate in the test oven body is controlled by regulating the number of revolutions per minute of the blower in accordance with a signal of detected oxygen concentration from the oxygen concentration detector, to enable the oxygen concentration in the test oven body to be controlled.

It is also possible to switch one of an operation for supplying oxygen or nitrogen from the oxygen and nitrogen supply unit and an operation for introducing the atmospheric air from the atmospheric air supply passage to the other by the circuit change-over control valve provided in the outer air circulating passage.

The above and other objects as well as advantageous features of the invention will become apparent from the following description of the preferred embodiments taken in conjunction with the accompanying drawings.

DESCRIPTION OF THE PREFERRED EMBODIMENTS

Figure 1:
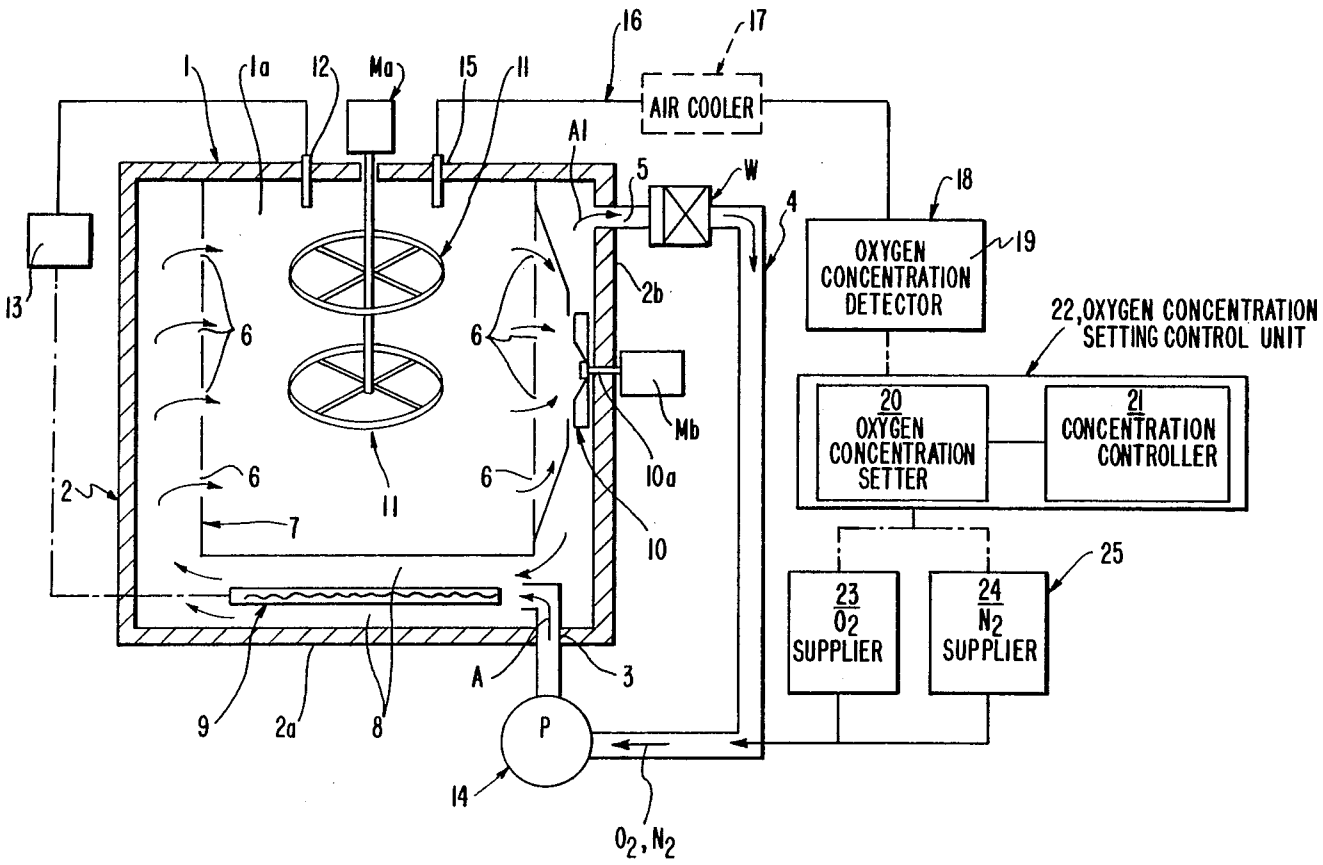
FIG. 1 is a schematic construction diagram of an oven provided with a first embodiment of the oxygen concentration control according to the present invention.

FIG. 1 is a construction diagram of a ventilation regulated oven to which an embodiment of the present invention is applied. A test oven body 1 consists of a hollow, cross-sectionally square box having heat-insulating walls 2, a door (not shown) which can be opened and closed for the insertion and withdrawal of a sample being provided at a side portion of the oven body 1. A lower wall 2*a* of the test oven body 1 is provided with a supply port 3 for the air A, and an upper portion of a wall 2*b* a discharge port 5 for the exhaust air A1, which is joined to an outer air circulating passage 4, an exhaust air treatment unit W being provided in the vicinity of the outer end of the discharge port 4.

The generally closed test oven body 1 is provided therein with an air circulating passage 8 extending through a partition member 7 having a plurality of air vents 6, and a heater 9 is installed in their air circulating passage 8, an air circulating fan 10 being provided at the central portion of the wall of the test oven body. Sample rotating frames 11 adapted to be iriven by a motor Ma are provided in the upper portion of the interior of the test oven body 1 so that a plurality of samples to be subjected to a heat aging test can be suspended therefrom.

The air circulating fan 10 is opposed to the outer side of the partition member 7 and provided with a rotary shaft 10*a* so that the axis of the shaft 10*a* is aligned with the center lines of the opposite walls of the test oven body 1. The fan 10 is adapted to be rotated by a motor Mb so as to circulate the air in the test chamber.

The test chamber in the test oven 1 is provided therein with a temperature detector 12 for measuring the temperature therein during a test, and this temperature detector 12 is connected to a temperature regulator 13 provided on the outer side of the test oven body 1.

The temperature regulator 13 is adapted to control the heater 9 provided in the lower portion of the air circulating passage 8, so as to constantly maintain the temperature in the test oven body 1 at a predetermined level.

The outer air circulating passage 4 connected to the supply port 3 of the test oven body 1 is provided with a blower 14 adapted to send air into the test oven body 1 at a predetermined flow rate, the outer air circulating passage 4 being also connected to the air discharge port 5 via an exhaust air treatment unit W.

An air sampling member 15 for sampling the air in the test oven body 1 is fastened to the upper portion thereof, and a sampling pipe 16 connected to the sampling member 15 is provided therein with a means 17 for cooling the air A, and an oxygen concentration detector 18.

This oxygen concentration detector 18 is adapted to detect the oxygen concentration in the air A collected in the air sampling member 15, and to output from its output terminal a voltage corresponding to a detected oxygen concentration.

An oxygen concentration detecting circuit 19, which connects together the oxygen concentration detector 18 and the portion of the outer air circulating passage 4 which is on the upstream side of the blower 14, is provided with an oxygen concentration setting control unit 22 consisting of an oxygen concentration setter 20, an oxygen concentration controller 21, which is adapted to constantly compare a reference output level generated on the basis of a concentration level set in the oxygen concentration setter 20 with an output level sent out from the oxygen concentration detector 18 and control the actual oxygen concentration to a set level, an amplifier 21*a*.

An oxygen and nitrogen supply unit 25 consisting of an oxygen supplier 23 and a nitrogen supplier 24 is connected to the oxygen concentration controller 21, so as to supply oxygen $O_2$ or nitrogen $N_2$ to the interior of the portion of the outer air circulating passage 4 which is on the upstream side of the blower 14 in accordance with an output signal from the oxygen concentration setting control unit 22, whereby the oxygen concentration is regulated properly.

Figure 4:
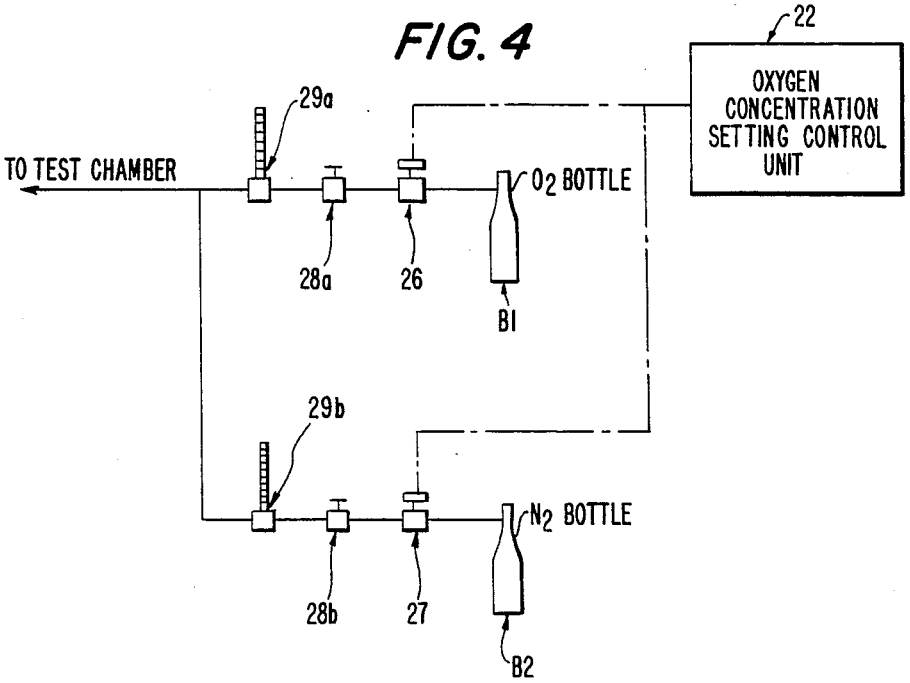
FIGS. 4 and 5 illustrate control circuits for an oxygen concentration setting control unit and an oxygen and nitrogen supply unit.
Figure 5:
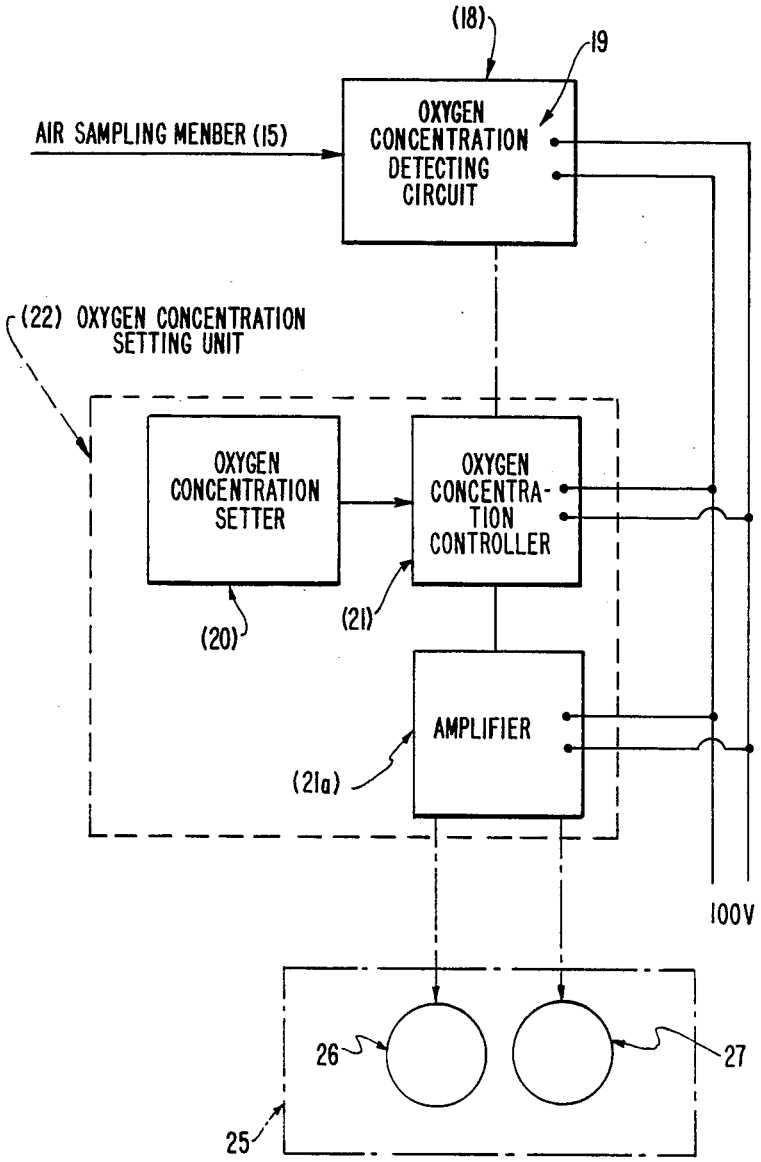

The oxygen concentration setting control unit 22 and oxygen and nitrogen supply unit 25 are constructed as shown in FIGS. 1, 4 and 5. The oxygen concentration setter 20 is adapted to generate a reference voltage on the basis of a preset oxygen concentration level, and the oxygen concentration controller 21 to constantly compare a reference voltage based on a set level of oxygen concentration with a voltage corresponding to the oxygen concentration detected by the oxygen concentration detector 18.

When a potential difference occurs between a voltage representative of a decrease of the oxygen concentration and a reference voltage, oxygen $O_2$ is supplied from an oxygen bottle B1 to the interior of the portion of the outer air circulating passage 4 which is on the upstream side of the blower 14 by controlling an electromagnetic valve 26 for the oxygen supplier 23 in the oxygen and nitrogen supply unit 25, to control the concentration of the oxygen $O_2$ in the test oven body 1. In order to control the concentration of the oxygen $O_2$ to not more than 21%, nitrogen $K_2$ is supplied from a nitrogen bottle 32 to the interior of the test oven body 1 by controlling an electromagnetic valve 27 for the nitrogen supplier 24 in accordance with a difference between a reference voltage and a voltage representative of a detected oxygen concentration, to control the oxygen concentration. Referring to FIG. 4, reference numerals 28*a*, 28*b* denote flow rate regulating valves, and 29*a*, 29*b* flow meters.

The cooling means 17 is adapted to cool the air A, which has been taken out from the interior of the test oven body 1, before it has entered the oxygen concentration detector 18. It is possible to design two types of means used as the cooling means 17, which are an air cooling means shown in FIG. 2, and a water cooling means shown in FIG. 3.

Figure 2:
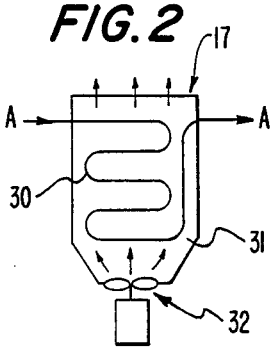
FIGS. 2 and 3 illustrate cooling means.

In the air cooling means shown in FIG. 2, air is sent by a cooling fan 32 into a cooling chamber 31 in which an air flow pipe 30 is housed, to cool the air A flowing in the air flow pipe 30.

Figure 3:
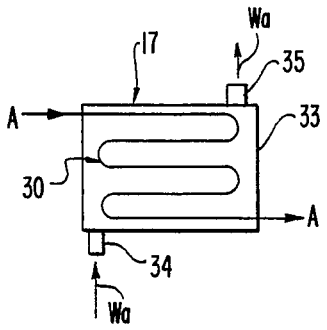

In the water cooling means shown in FIG. 3, cooling water Wa is sent from a water feed port 34, which is provided at the lower portion of the cooling means, into a cooling tank 33 in which an air flow pipe 30 is housed, and discharged from a water discharge port 35 provided at the upper portion of the cooling means, to cool the air A flowing in the air flow pipe 30.

The operation of the embodiment will now be described.

The air A sent by the blower 14 into the test oven body 1 is regulated to a predetermined flow rate and enters the air circulating passage 8, in which the temperature of the air is regulated to a predetermined level by the heater 9 the temperature of which is controlled in accordance with a signal from the temperature regulator 13, the air then flowing from the partition member 7 having a plurality of air vents 6 into the test chamber la in the test oven body 1.

The air A sent into the test chamber 1*a* is sucked by the air circulating fan 10 and returned to the air circulating passage 8 through the air vents 6 in the partition member 7, the resultant air flowing into the test chamber 1*a* again. The air A is thus circulated.

A part of the air A being circulated is discharged from the discharge port 5 provided in the space above the air circulating fan 10, and it is subjected to the removal of an impurity gas in the exhaust air treatment unit W provided in the outer air circulating passage 4. The resultant air is returned from the outer air circulating passage 4 to the test oven body 1 via the blower 14.

The detecting of the oxygen concentration of the air A is done by collecting the air A from the test chamber la in the test oven body 1 via the air sampling member 15, cooling this air to a predetermined temperature by the cooling means 17 and then sending the cooled air to the oxygen concentration detector 18 provided at the end portion of the sampling pipe 16.

The air A which has been cooled to a predetermined temperature by the cooling means 17 is introduced at a predetermined flow rate into the oxygen concentration detector 18 by a pump (not shown) provided therein. The oxygen concentration of the air is detected in the detector 18 and a voltage corresponding to the detected level of oxygen concentration is outputted from the output terminal thereof.

Examples of voltages with respect to the levels of oxygen concentration are shown in Table 1.

TABLE 1

| Oxygen concentration (%) | 5 | 10 | 15 | 20 | 21 | 22 | 23 | 24 | 25 | 30 |
|---|---|---|---|---|---|---|---|---|---|---|
| Output voltage (mV) | 2.0 | 4.0 | 6.0 | 8.0 | 8.4 | 8.8 | 9.2 | 9.6 | 10.0 | 12.0 |

A circuit is designed so that, when a detected oxygen concentration is 21%, a voltage of 8.4 mV occurs, to obtain an oxygen concentration detecting circuit shown in FIG. 5.

An oxygen concentration setting control unit 22 containing a constant voltage device which is not influenced by even a power source voltage (100V) is provided to generate a reference output in accordance with a set concentration in the oxygen concentration setter 20. If the oxygen concentration is set to 21%, a reference voltage of 8.4 mV is generated.

The reference output voltage generated on the basis of a set oxygen concentration and the output voltage from the oxygen concentration detector 18 are constantly compared, and the actual oxygen concentration is controlled to the set level by the oxygen concentration controller 21. A potential difference between these two voltages is amplified by the amplifier 2l*a*, and oxygen $O_2$ is supplied from the oxygen bottle 1 to the interior of the portion of the outer air circulating passage 4 which is on the upstream side of the blower 14 by controlling the electromagnetic valve 26 for the oxygen supplier 23 in the oxygen and nitrogen supply unit 25. Thus, the concentration of the oxygen $O_2$ in the test oven body 1 is regulated.

In order to control the concentration of the oxygen $O_2$ to not more than 21%, nitrogen $N_2$ is supplied from the nitrogen bottle B2 to the test oven body 1 by controlling the electromagnetic valve 27 for the nitrogen supplier 24 on the basis of a reference voltage and a voltage corresponding to a detected concentration. Thus, the oxygen concentration is controlled.

The oxygen concentration in the test oven 1, which is usually set to 21%, can be set and controlled to not less than 21%. For example, when an oxygen concentration of 25% is set in the oxygen concentration setting control unit 22, an output signal corresponding to an oxygen concentration detected by the oxygen concentration detector 18 and a reference output level (10.0 mV according to an example in Table 1) corresponding to a set level of oxygen concentration are compared, and the oxygen concentration in the test oven body 1 is controlled to 25% by controlling the oxygen supplier 23 by the oxygen concentration setting control unit 22 so that the signal output level becomes equal to the reference output level. If the oxygen concentration is controlled to a level higher than that of the oxygen concentration of the atmospheric air, the oxidation effect of the oxygen $O_2$ which is other than the sample aging effect of the heat increases to enable an oxidation promoting test to be also carried out.

Figure 6:
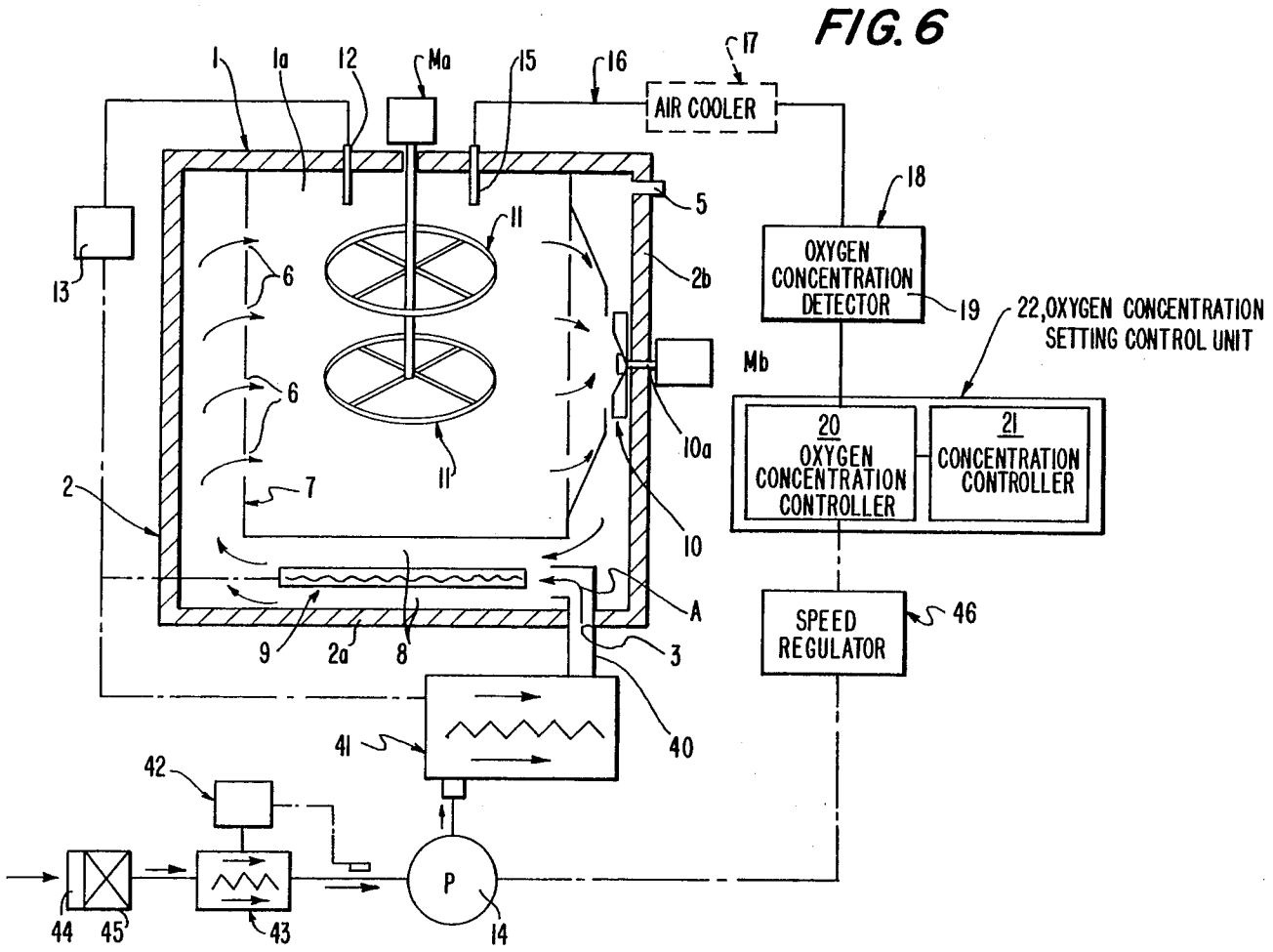
FIG. 6 is a schematic construction diagram of a second embodiment of the present invention.

FIG. 6 shows a second embodiment of the present invention, which is constructed so that the oxygen concentration in a test oven body 1 is controlled by taking the atmospheric air thereinto.

This embodiment will now be described with such constituent elements thereof that are identical with those of the first embodiment designated by the same reference symbols.

An air introducing pipe 40 is connected to a supply port 3, which is used for the introduction of the air A, of a test oven 1, and a preheating means 41 consisting of a hot air box and adapted to preheat the air A to a predetermined temperature, i.e. a temperature, which is higher than that of the atmospheric air outside the test oven body 1, in accordance with a command from a temperature regulator 13 and supply the preheated air to the interior of a test chamber 1*a* is provided in this air introducing pipe 40, a blower 14 being connected to the preheating means 41.

The regulating of the temperature of a heater 9 in the test oven body is done in accordance with a command from the temperature regulator 13 in the same manner as in the first embodiment.

A preheater 43 provided with a temperature regulator 42 is connected to the blower 14, and an air cleaner 45 provided with a dust removing filter 44 to this preheater 43.

A revolution number regulator 46 provided in an oxygen concentration detecting circuit 19 is connected to the blower 14, and a reference voltage corresponding to an oxygen concentration set in an oxygen concentration setting control unit 22 and a voltage corresponding to an oxygen concentration detected by an oxygen concentration detector 18 are constantly compared. When a potential difference occurs, the revolution number regulator 46 is operated in accordance therewith to control the flow rate of the air while controlling the blower 14 to a predetermined number of revolutions per minute.

For example, in a test oven body having a capacity of 245 l, the relation between the frequency of ventilation and flow rate of the air becomes as shown in Table 2. The oxygen concentration can be controlled by varying the frequency of ventilation.

TABLE 2

| Frequency of ventilation Number/Hr | Flow rate l/Hr |
|---|---|
| 1 | 245 |
| 2 | 490 |
| 3 | 735 |
| 4 | 980 |
| 5 | 1225 |
| 6 | 1470 |
| 7 | 1715 |
| 8 | 1960 |
| 9 | 205 |
| 10 | 2450 |

A frequency for the revolution number regulator 46 is set correspondingly to a signal from the oxygen concentration setting control unit 22, and the number of revolutions per minute of the blower 14 is controlled in accordance with the frequency.

Since the construction and operation of the other parts of this embodiment are the same as those of the corresponding parts of the first embodiment, the descriptions thereof are omitted.

Figure 7:
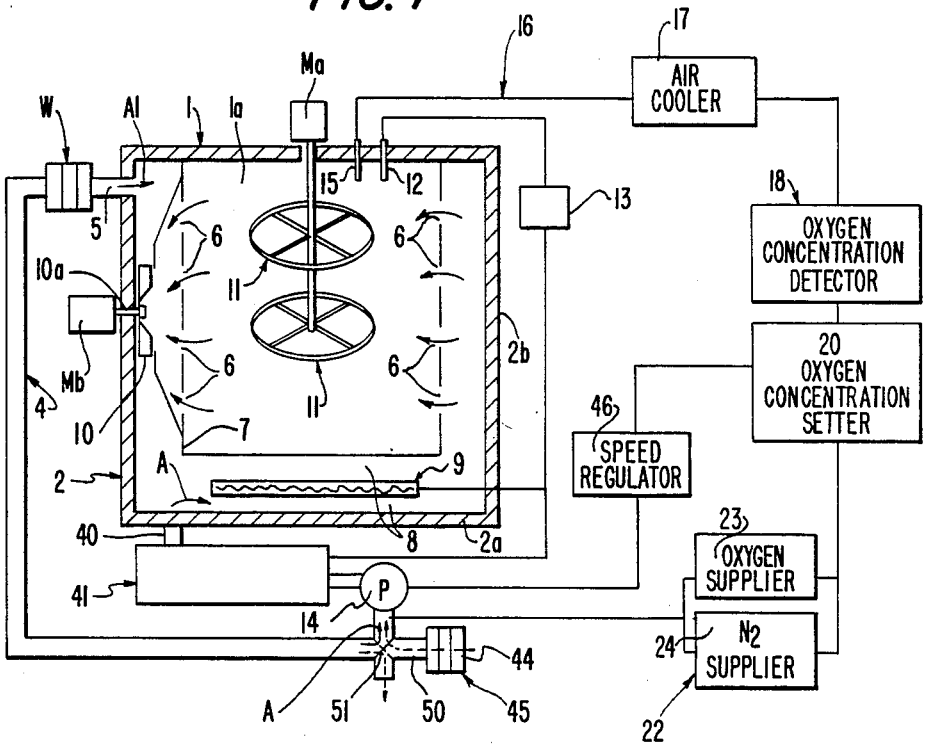
FIG. 7 is a schematic construction diagram of a third embodiment of the present invention.
Figure 8:
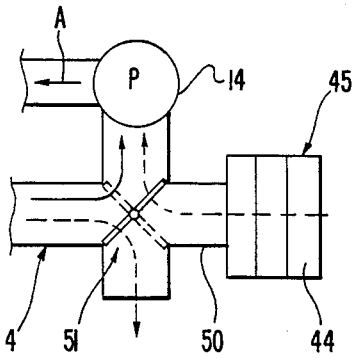
FIG. 8 illustrates a circuit change-over control valve in the embodiment of FIG. 7.

FIGS. 7 and 8 show a third embodiment of the present invention, which is obtained by combining the first embodiment of FIG. 1 with the second embodiment of FIG. 6. In the third embodiment, a change-over operation is carried out by operating a circuit change-over control valve 51 when the oxygen concentration is regulated by positively supplying oxygen $O_2$ or nitrogen $N_2$ to the interior of the portion of an outer air circulating passage 4 which is on the upstream side of a blower 14 in accordance with a signal outputted from an oxygen concentration setting control unit 22 correspondingly to the oxygen concentration in a test oven body 1, or when the oxygen concentration is regulated by controlling an air replacement rate with the atmospheric air introduced from an atmospheric air supply passage 50 connected to the portion of the outer air circulating passage 4 which is on the upstream side of the blower 14. This change-over control operation can be can be carried out arbitrarily by an operator, or automatically in accordance with the oxygen concentration.

As shown in FIG. 8, the atmospheric air supply passage 50 is connected to the portion of the outer air circulating passage 4 which is on the upstream side of the blower 14, and the circuit change-over control valve 51 is provided in this outer air circulating passage 4.

Since the construction an operation of the other parts of this embodiment are the same as those of the corresponding parts of the first and second embodiments, the descriptions thereof are omitted.

According to the present invention described above, air is supplied to and circulated in the test oven body constantly at a predetermined flow rate, and the oxygen concentration in the test chamber is detected, the detected level being compared with the set level of oxygen concentration. When the oxygen concentration in the test chamber decreases, a heat aging test is conducted as the oxygen is supplied so as to constantly regulate the oxygen concentration to a predetermined level. Accordingly, the temperature, flow rate and quantity of the air applied to the sample and the oxidation effect of oxygen can be controlled to predetermined levels. As a result, the accuracy of a heat aging test is improved, and test results of a high reproducibility can be obtained.

If the oxygen concentration in the test oven body is increased to a level higher than that of the oxygen concentration in the air, the sample oxidizing effect thereof increases. Therefore, a test for promoting the oxidation of a sample can be carried out, and it becomes possible to make clear the unknown properties of products of rubber or a plastic.

The present invention is not, of course, limited to the above embodiments; it may be modified in various ways within the scope of the appended claims.

What is claimed is:

1. A test oven wherein heated air having a predetermined temperature is supplied and the oxygen concentration in the supplied air is controlled, said test oven comprising:

a test oven body having an air supply port and an air discharge port;

a blower connected to said air supply port for blowing air into said air supply port;

an oxygen concentration detector connected to said test oven body and having an oxygen concentration detecting circuit therein;

an oxygen concentration setting control unit connected to said oxygen concentration detecting circuit and including an oxygen concentration setter for setting a desired level of oxygen, and an oxygen concentration controller constantly comparing a reference output level generated on the basis of a concentration level set in advance in said oxygen concentration setter with an output level outputted from said oxygen concentration detector and for controlling said actual output level to a set level; and at least one oxygen concentration adjusting means taken from (a) an outer air circulating passage connecting said air supply port and the intake side of said blower, and an oxygen and nitrogen supply unit to which said oxygen concentrating setting control unit is connected for supplying said actual output level thereto and which is connected to said air circulating passage upstream of said blower for supplying an amount of oxygen and/or nitrogen for regulating the concentration of the oxygen in response to said actual output level; and (b) an outside air supply passage connected to the intake side of said blower for supplying outside air to said blower, and a blower speed control means connected between said oxygen concentrating setting control unit and said blower for controlling the speed of said blower in accordance with said actual output level.

2. A test oven as claimed in claim 1 in which there are both said oxygen concentration adjusting means, and said outside air supply passage is connected to said outer air circulating passage upstream of said blower, and said test oven further comprises a changeover valve at the junction of said outside air supply passage and said outer air circulating passage for switching over flow of air from said outside air supply passage to said blower to flow of air from said outer air circulating passage to said blower.

3. A test oven wherein heated air having a predetermined temperature is supplied and the oxygen concentration in the supplied air is controlled, said test oven comprising:

a test oven body having an air supply port and an air discharge port;

a blower connected to said air supply port for blowing air into said air supply port;

an oxygen concentration detector connected to said test oven body and having an oxygen concentration detecting circuit therein;

an oxygen concentration setting control unit connected to said oxygen concentration detecting circuit and including an oxygen concentration setter for setting a desired level of oxygen, and an oxygen concentration controller constantly comparing a reference output level generated on the basis of a concentration level set in advance in said oxygen concentration setter with an output level outputted from said oxygen concentration detector and for controlling said actual output level to a set level; and an oxygen concentration adjusting means constituted by an outer air circulating passage connecting said air supply port and the intake side of said blower, and an oxygen and nitrogen supply unit to which said oxygen concentrating setting control unit is connected for supplying said actual output level thereto and which is connected to said air circulating passage upstream of said blower for supplying an amount of oxygen and/or nitrogen for regulating the concentration of the oxygen in response to said actual output level.

* * * * *